US011732667B2

(12) United States Patent
Itaba et al.

(10) Patent No.: US 11,732,667 B2
(45) Date of Patent: Aug. 22, 2023

(54) FUEL INJECTION CONTROL DEVICE AND FUEL INJECTION CONTROL METHOD

(71) Applicant: Hitachi Astemo, Ltd., Hitachinaka (JP)

(72) Inventors: Fumihiro Itaba, Hitachinaka (JP); Osamu Mukaihara, Hitachinaka (JP); Satoshi Kojima, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 106 days.

(21) Appl. No.: 17/595,285

(22) PCT Filed: Mar. 11, 2020

(86) PCT No.: PCT/JP2020/010440
§ 371 (c)(1),
(2) Date: Nov. 12, 2021

(87) PCT Pub. No.: WO2020/240985
PCT Pub. Date: Dec. 3, 2020

(65) Prior Publication Data

US 2022/0220916 A1 Jul. 14, 2022

(30) Foreign Application Priority Data

May 24, 2019 (JP) ..... 2019-097949

(51) Int. Cl.
*F02D 41/20* (2006.01)
*F02D 41/22* (2006.01)

(52) U.S. Cl.
CPC ..... *F02D 41/20* (2013.01); *F02D 41/22* (2013.01); *F02D 2041/201* (2013.01);
(Continued)

(58) Field of Classification Search
CPC .. F02D 41/20; F02D 41/22; F02D 2041/2003; F02D 2041/2006;
(Continued)

(56) References Cited

U.S. PATENT DOCUMENTS

2015/0377176 A1* 12/2015 Hatanaka ..... F02D 41/20 137/554
2016/0076498 A1* 3/2016 Aono ..... F02D 41/2467 123/490

(Continued)

FOREIGN PATENT DOCUMENTS

JP 2014-152697 A 8/2014
WO WO 2013/191267 A1 12/2013
WO WO 2017/006814 A1 1/2017

OTHER PUBLICATIONS

International Search Report (PCT/ISA/210) issued in PCT Application No. PCT/JP2020/010440 dated Jun. 30, 2020 with English translation (four (4) pages).

(Continued)

*Primary Examiner* — Erick R Solis
(74) *Attorney, Agent, or Firm* — Crowell & Moring LLP

(57) ABSTRACT

Appropriate detection of an abnormality of voltage information, which is a basis for correcting a fuel injection amount, becomes possible. For this reason, a fuel injection control device 127, which has a drive IC 208 controlling a fuel injection drive unit 207*a* to supply a high voltage to a solenoid 405 so as to open a fuel injection valve 105 and controlling the fuel injection drive unit 207*a* to supply a low voltage to the solenoid 405 so as to hold a valve-open state of the fuel injection valve 105, includes: a drive voltage input unit 211 that measures and outputs voltage information based on an upstream voltage of the solenoid 405 of the fuel injection valve 105 and a downstream voltage of the solenoid 405; a fuel injection amount correction unit 213 that corrects a fuel injection amount of the fuel injection valve 105 based on the voltage information output from the drive voltage input unit 211; and a voltage input function abnormality detection unit 212 that detects whether an output of the drive voltage input unit 211 is abnormal based on the (Continued)

voltage information output from the drive voltage input unit 211.

14 Claims, 9 Drawing Sheets

(52) U.S. Cl.
CPC ..... *F02D 2041/2003* (2013.01); *F02D 2041/2006* (2013.01); *F02D 2041/2013* (2013.01); *F02D 2041/2051* (2013.01); *F02D 2041/2055* (2013.01); *F02D 2041/224* (2013.01)

(58) Field of Classification Search
CPC ..... F02D 2041/201; F02D 2041/2013; F02D 2041/2051; F02D 2041/2055
See application file for complete search history.

(56) References Cited

U.S. PATENT DOCUMENTS

| | | | | |
|---|---|---|---|---|
| 2018/0195450 | A1 | 7/2018 | Mukaihara et al. | |
| 2021/0123393 | A1* | 4/2021 | Itaba | F02M 51/06 |
| 2022/0082060 | A1* | 3/2022 | Mori | F02D 41/401 |
| 2022/0090555 | A1* | 3/2022 | Takaya | F02D 41/247 |

OTHER PUBLICATIONS

Japanese-language Written Opinion (PCT/ISA/237) issued in PCT Application No. PCT/JP2020/010440 dated Jun. 30, 2020 (four (4) pages).

* cited by examiner

FUEL INJECTION CONTROL DEVICE AND FUEL INJECTION CONTROL METHOD

TECHNICAL FIELD

The present invention relates to a fuel injection control device or the like that controls a fuel injection valve which supplies fuel to an internal combustion engine.

BACKGROUND ART

There is a demand for achievement of low fuel consumption and high output of an internal combustion engine at the same time and adaptation to a wide operation region of an engine due to the reinforcement of automobile fuel consumption and exhaust regulations in recent years. As one of methods for achievement thereof, expansion of a dynamic range of a fuel injection valve is required.

In order to expand the dynamic range of the fuel injection valve, it is necessary to improve dynamic flow characteristics while securing conventional static flow characteristics. As a method for improving the dynamic flow characteristics, reduction of a minimum injection amount by half-lift control is known.

In this half-lift control, highly accurate control is performed in a state (half-lift region) before a valve body of a fuel injection valve completely reaches a valve-open position (full-lift position), but it is known that the injection amount in the half-lift region greatly varies due to an individual difference of the fuel injection valve. That is, even if the respective fuel injection valves are driven with the same pulse width (drive pulse for controlling opening and closing of the fuel injection valves), the movement of the valve body of each of the fuel injection valves changes due to a solid difference such as a spring characteristic and a solenoid characteristic of each of the fuel injection valves so that valve opening completion times and valve closing completion times of the fuel injection valves vary, which causes the variation in the injection amount.

For this reason, various techniques for sensing an individual difference generated for each fuel injection valve have been proposed. For example, PTL 1 discloses a technique for indirectly sensing an individual difference based on an electrical characteristic in a valve opening operation (specifically, a timing at which a valve body enters a valve-open state) of a fuel injection valve. Further, a technique for sensing a valve closing operation of a fuel injection valve from an electrical characteristic is also known, and a technique for correcting a variation in an injection amount by correcting a drive current and an injection pulse using information of a solid difference is also known.

Meanwhile, it is necessary to sense a solid difference in a state where factors that change the electrical characteristic due to disturbances other than the solid difference are excluded in order to sense the solid difference of the fuel injection valve from the electrical characteristic with high accuracy. Therefore, PTL 2 discloses a technique for sequentially monitoring a state change of an internal combustion engine, such as a variation of a fuel pressure, a rotational speed of the internal combustion engine, a length of a drive pulse, and an interval between a drive pulse and a drive pulse of the next injection at the time of sensing a solid difference of a fuel injection valve and stopping or prohibiting the sensing of the solid difference when it is determined that a valve behavior of each fuel injection valve changes due to these disturbance factors.

CITATION LIST

Patent Literature

PTL 1: JP 2014-152697 A
PTL 2: WO 2017/006814 A

SUMMARY OF INVENTION

Technical Problem

In the technique described in PTL 2, however, whether to execute the sensing of the solid difference according to the state of the internal combustion engine is only determined. As described above, the solid difference of the fuel injection valve allows indirect sensing of the valve opening completion or the valve closing completion based on the electrical characteristic. Thus, a failure in an input circuit of an electric signal for sensing the electrical characteristic or a drive circuit for driving a filter function, a fuel injection valve body, or the fuel injection valve becomes the disturbance in the sensing of the solid difference. That is, when the sensing of the solid difference is performed in a state where the above-described failure occurs, solid difference information does not become information on the valve opening completion or the valve closing completion. Thus, if an injection amount is corrected based on these pieces of information, a divergence between a target injection amount and an actual injection amount becomes large, which is likely to cause deterioration in fuel consumption performance and exhaust performance and an unintended torque variation of the internal combustion engine.

The present invention has been made in view of the above circumstances, and an object thereof is to provide a technique capable of appropriately detecting an abnormality of voltage information, which is a basis for correcting a fuel injection amount.

Solution to Problem

In order to achieve the above object, a fuel injection control device according to one aspect is a fuel injection control device including: a first voltage supply unit that supplies a first voltage; a second voltage supply unit that supplies a second voltage higher than the first voltage; and a fuel injection control unit that controls the second voltage supply unit to supply the second voltage to a coil so as to open a fuel injection valve having the coil, and controls the first voltage supply unit to supply the first voltage to the coil so as to hold a valve-open state of the fuel injection valve, and includes: a voltage measurement unit that measures and outputs voltage information based on an upstream voltage of the coil of the fuel injection valve and a downstream voltage of the coil; a correction unit that corrects a fuel injection amount of the fuel injection valve based on the voltage information output from the voltage measurement unit; and an abnormality detection unit that detects whether an output of the voltage measurement unit is abnormal based on the voltage information output from the voltage measurement unit.

Advantageous Effects of Invention

According to the present invention, it is possible to appropriately detect an abnormality of voltage information, which is a basis for correcting a fuel injection amount.

DESCRIPTION OF EMBODIMENTS

Several embodiments will be described with reference to the drawings. Incidentally, the embodiments to be described hereinafter do not limit the invention according to the claims, and further, all of the elements described in the embodiments and combinations thereof are not necessarily indispensable for the solution of the invention.

Figure 1:
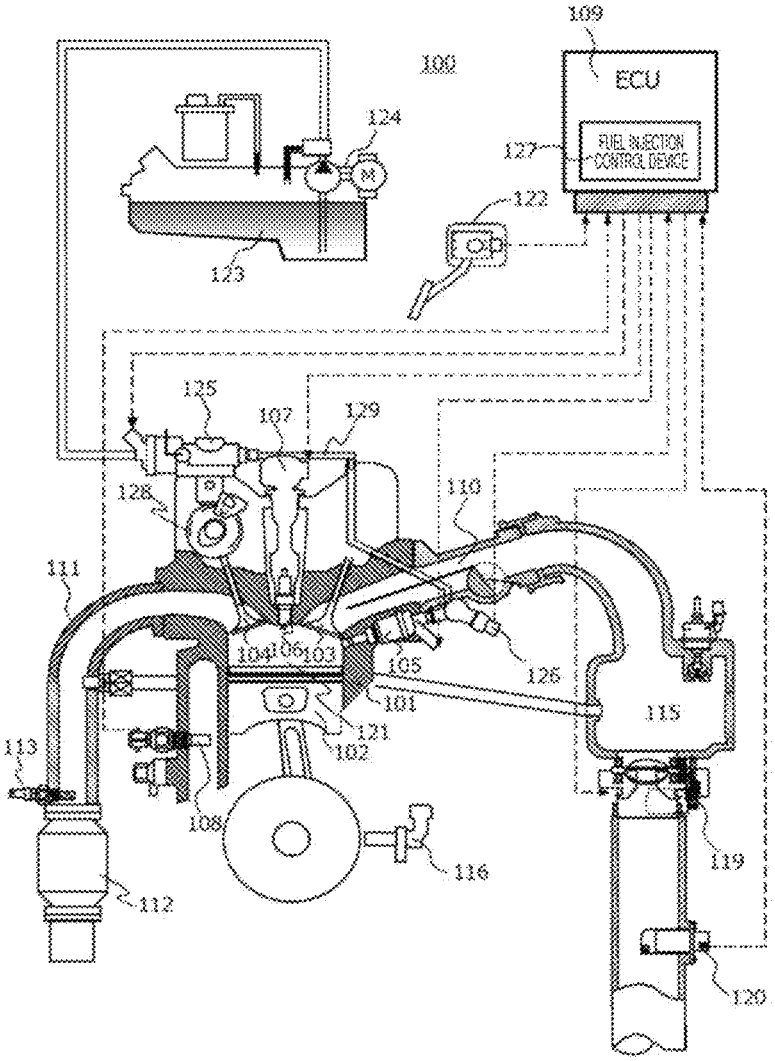
FIG. 1 is an overall configuration diagram of an internal combustion engine system according to an embodiment.

FIG. 1 is an overall configuration diagram of an internal combustion engine system according to an embodiment. Incidentally, only one cylinder among a plurality of cylinders of the engine 101 is illustrated in FIG. 1.

An internal combustion engine system 100 includes an engine 101, which is an example of an internal combustion engine, and an engine control unit (ECU) 109. The engine 101 is, for example, an in-line four-cylinder gasoline engine.

Air sucked into the engine 101 from an intake port (not illustrated) flows to a collector 115 via an air flow meter (AFM) 120 and a throttle valve 119. The air flow meter 120 measures an amount of intake air (intake air amount). The air flowing into the collector 115 is supplied into a combustion chamber 121 via an intake pipe 110 and an intake valve 103 connected to each cylinder of the engine 101.

Meanwhile, fuel stored in a fuel tank 123 is sucked by a low-pressure fuel pump 124 and supplied to a high-pressure fuel pump 125 provided in the engine 101. In the high-pressure fuel pump 125, an internal plunger is operated up and down by motive power transmitted from an exhaust camshaft (not illustrated) provided with an exhaust cam 128, thereby increasing the pressure of the supplied fuel. The high-pressure fuel pump 125 controls a solenoid of an on-off valve of a suction port (not illustrated) based on a control command from a fuel injection control device 127 of the ECU 109 such that fuel to be discharged has a desired pressure. The fuel discharged from the high-pressure fuel pump 125 is supplied to a fuel injection valve 105 via a high-pressure fuel pipe 129. The fuel injection valve 105 injects the fuel into the combustion chamber 121 based on a command from the fuel injection control device 127 of the ECU 109.

The engine 101 is provided with a fuel pressure sensor 126 that measures the pressure (fuel pressure) of fuel in the high-pressure fuel pipe 129. The ECU 109 performs feedback control based on a measurement result (sensor value) of the fuel pressure sensor 126, that is, transmits a control command to the high-pressure fuel pump 125 such that the fuel pressure in the high-pressure fuel pipe 129 becomes a desired pressure.

The engine 101 further includes, for each combustion chamber 121, an ignition plug 106 configured to emit a spark inside the combustion chamber 121, and an ignition coil 107 supplying electric power to the ignition plug 106. The ECU 109 controls energization to the ignition coil 107 such that the spark is emitted from the ignition plug 106 at a desired timing.

An air-fuel mixture of air and fuel supplied into the combustion chamber 121 is burned by the spark emitted from the ignition plug 106. A piston 102 is pushed down by the pressure generated by the combustion of the air-fuel mixture. An exhaust gas generated by the combustion is guided to a three-way catalyst 112 via an exhaust valve 104 and an exhaust pipe 111. The three-way catalyst 112 performs exhaust purification processing for purifying an exhaust gas. The exhaust gas purified by the three-way catalyst 112 flows downstream and is finally released to the atmosphere.

The internal combustion engine system 100 includes: a water temperature sensor 108 that measures a temperature of cooling water for cooling the engine 101; a crank angle sensor 116 that measures an angle of a crank shaft (not illustrated) of the engine 101; the AFM 120 that measures an intake air amount; an oxygen sensor 113 that detects an oxygen concentration in an exhaust gas in the exhaust pipe 111; an accelerator opening-degree sensor 122 that detects an opening degree (accelerator opening degree) of an accelerator operated by a driver; and the fuel pressure sensor 126 that measures the pressure of fuel in the high-pressure fuel pipe 129.

The ECU 109 receives signals of measurement results from sensors such as the water temperature sensor 108, the crank angle sensor 116, the AFM 120, the oxygen sensor 113, the accelerator opening-degree sensor 122, and the fuel pressure sensor 126.

The ECU 109 executes various processes based on various input signals. For example, the ECU 109 performs a process of calculating a required torque of the engine 101 based on the signal input from the accelerator opening-degree sensor 122, and performs a process of determining whether the engine 101 is in an idle state, and the like. Further, the ECU 109 performs a process of calculating a rotation speed of the engine (engine rotation speed) based on the signal input from the crank angle sensor 116. Further, the ECU 109 performs a process of determining whether the three-way catalyst 112 is in a state of being warmed up based on a coolant temperature input from the water temperature sensor 108, the elapsed time since the engine start, and the like.

Further, the ECU 109 calculates an intake air amount necessary for the engine 101 based on the calculated required torque and the like, and outputs a signal for setting an opening degree corresponding to the calculated intake air amount to the throttle valve 119. The fuel injection control device 127 is incorporated in the ECU 109. The fuel injection control device 127 of the ECU 109 calculates a fuel amount (required injection amount) corresponding to the intake air amount, outputs a fuel injection signal to the fuel injection valve 105, and further outputs an ignition signal to the ignition coil 107.

Next, the fuel injection control device 127 and portions related to the fuel injection control device 127 will be described in detail.

Figure 2:
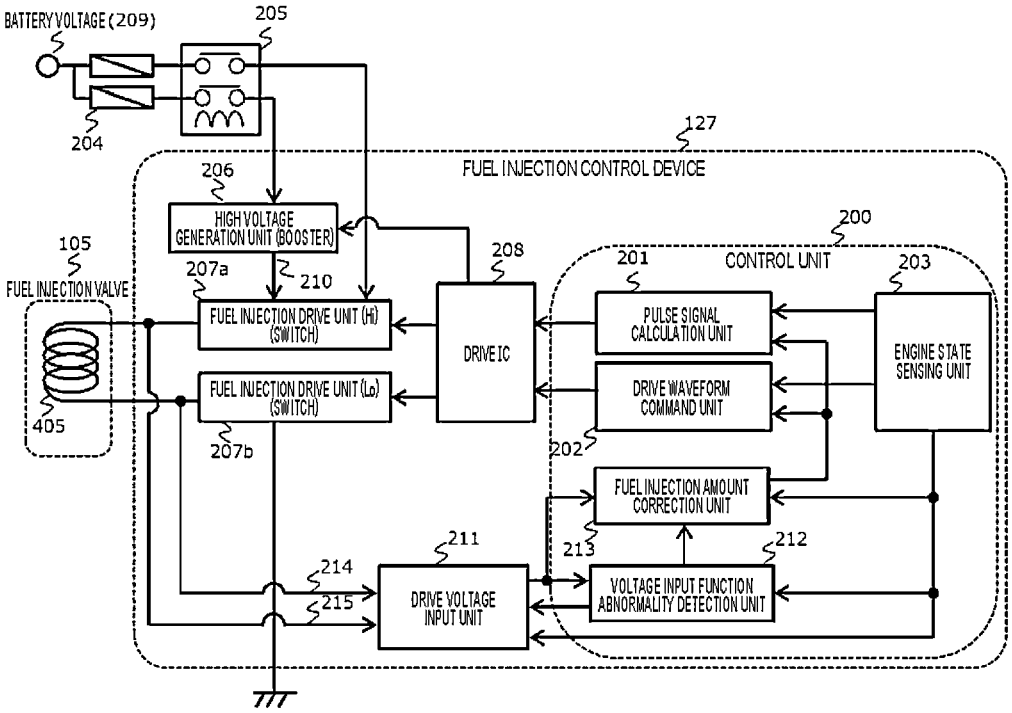
FIG. 2 is a configuration diagram of a fuel injection control device and related portions according to the embodiment.

FIG. 2 is a configuration diagram of the fuel injection control device and related portions according to an embodiment.

The fuel injection control device 127 of the ECU 109 includes a control unit 200, a drive integrated circuit (IC) 208, a high voltage generation unit 206, fuel injection drive units 207*a* and 207*b*, and a drive voltage input unit 211. A battery voltage 209 supplied from a battery (not illustrated) is supplied to the high voltage generation unit 206 and the fuel injection drive unit 207*a* via a fuse 204 and a relay 205.

The control unit 200 includes, for example, a microcomputer including a central processing unit (CPU), a memory (storage device), an I/O port, and the like. The control unit 200 includes a pulse signal calculation unit 201, a drive waveform command unit 202, an engine state sensing unit 203, a fuel injection amount correction unit 213 which is an example of a correction unit, and a voltage input function abnormality detection unit 212 which is an example of an abnormality detection unit.

The engine state sensing unit 203 collects various types of information such as an engine speed, an intake air amount, a coolant temperature, a fuel pressure, and a failure state of the engine, and provides the information to the pulse signal calculation unit 201 and the drive waveform command unit 202.

The pulse signal calculation unit 201 determines a width (energization time Ti) of an injection pulse signal that defines a fuel injection period by the fuel injection valve 105 based on various types of information from the engine state sensing unit 203 and information of the fuel injection amount correction unit 213, and outputs the width to the drive IC 208.

The drive waveform command unit 202 calculates a command value of a drive current to be supplied to open the fuel injection valve 105 or maintain the valve opening based on the various types of information from the engine state sensing unit 203 and information of the fuel injection amount correction unit 213, and outputs the command value as a command to the drive IC 208.

The fuel injection amount correction unit 213 detects an individual difference of the fuel injection valve 105 based on voltage difference information to be described later output from the drive voltage input unit 211, calculates information indicating a correction amount of a fuel injection amount according to the solid difference, and notifies the pulse signal calculation unit 201 and the drive waveform command unit 202 of the information.

The voltage input function abnormality detection unit 212 determines whether the voltage difference information output from the drive voltage input unit 211 is abnormal based on the voltage difference information output from the drive voltage input unit 211. Details of an abnormality determination process performed by the voltage input function abnormality detection unit 212 will be described later.

The drive voltage input unit 211 outputs the voltage difference information (an example of voltage information) based on a difference between a voltage (upstream voltage) on the upstream side of a solenoid 405 of the fuel injection valve 105 and a voltage (downstream voltage) on the downstream side. In the present embodiment, the drive voltage input unit 211 outputs, for example, a voltage obtained by dividing a differential voltage between the upstream voltage and the downstream voltage of the solenoid 405 of the fuel injection valve 105 at a predetermined ratio as the voltage difference information. Incidentally, a specific configuration of the drive voltage input unit 211 will be described later.

The drive IC 208 selects a drive period of the fuel injection valve 105 (energization time of the fuel injection valve 105), selects a drive voltage (selects either a high voltage 210 or the battery voltage 209), and determines a set value of a drive current based on a command from the pulse signal calculation unit 201 and a command from the drive waveform command unit 202, and controls the high voltage generation unit 206 and the fuel injection drive units 207*a* and 207*b* according to the determination, thereby controlling the drive current to be supplied to the fuel injection valve 105.

The high voltage generation unit 206 generates, from the battery voltage 209, a high power supply voltage (high voltage 210: second voltage) to be supplied to the fuel injection valve 105 at the time of opening a valve body provided in the electromagnetic solenoid type fuel injection valve 105, and supplies the high power supply voltage to the fuel injection drive unit 207*a*. Specifically, the high voltage generation unit 206 steps up the battery voltage 209 supplied from the battery so as to reach a desired target high voltage based on the command from the drive IC 208 to generate the high voltage 210 higher than the battery voltage 209. As a result, voltages of two systems, that is, the high voltage 210 for the purpose of ensuring a valve opening force of the valve body and the battery voltage 209 (low voltage: first voltage) for holding the valve opening such that the valve body is not closed after the valve opening, are provided as the power supply that supplies the voltage to the fuel injection valve 105, and the high voltage and the low voltage can be supplied.

The fuel injection drive unit 207*a* is electrically connected to the upstream side of the solenoid 405, which is an example of a coil of the fuel injection valve 105, and the supply control of the voltage to the fuel injection valve 105 and the selection of the voltage to be supplied (selection of the high voltage 210 generated by the high voltage generation unit 206 or the battery voltage 209) are performed based on the control by the drive IC 208. The fuel injection drive unit 207*a* corresponds to a first voltage supply unit and a second voltage supply unit.

The fuel injection drive unit 207*b* is electrically connected to the downstream side of the solenoid 405 of the fuel injection valve 105, and switches whether or not to ground the fuel injection valve 105 based on the control by the drive IC 208.

Next, configurations and operations of the fuel injection drive units 207*a* and 207*b* will be described.

Figure 3:
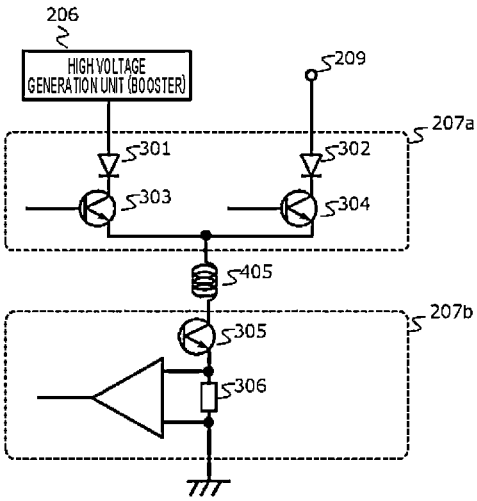
FIG. 3 is a diagram illustrating fuel injection drive units and a peripheral circuit according to the embodiment.

FIG. 3 is a diagram illustrating the fuel injection drive units and a peripheral circuit according to the embodiment.

The fuel injection drive unit 207*a* includes a diode 301, a switching element 303, a diode 302, and a switching element 304. The diode 301 has one end electrically connected to the high voltage generation unit 206, and the other end electrically connected to the switching element 303. The diode 301 prevents a reverse flow of a current to the high voltage generation unit 206. The switching element 303 is, for example, a transistor, and has a collector electrically connected to the diode 301, a base electrically connected to the drive IC 208, and an emitter electrically connected to the fuel injection valve 105 (specifically, the solenoid 405). The switching element 303 controls the supply of a current from the diode 301 to the fuel injection valve 105 based on a signal input from the drive IC 208 to the base. Through such a path, the current required to open the fuel injection valve 105 is supplied to the electric quantity injection valve 105.

The diode 302 has one end electrically connected to the battery voltage 209, and the other end electrically connected to the switching element 304. The diode 302 prevents a reverse flow of a current to the battery voltage 209. The switching element 304 is, for example, a transistor, and has a collector electrically connected to the diode 302, a base electrically connected to the drive IC 208, and an emitter electrically connected to the fuel injection valve 105 (specifically, the solenoid 405). The switching element 304 controls the supply of a current from the diode 302 to the fuel injection valve 105 based on a signal input from the drive IC 208 to the base.

Based on the output and command from the control unit 200, the fuel injection drive unit 207*a* applies the high voltage 210 generated by the high voltage generation unit 206 to the fuel injection valve 105 when a signal for turning on the switching element 303 is input from the drive IC 208, and applies the battery voltage 209 to the fuel injection valve 105 when a signal for turning on the switching element 304 is input from the drive IC 208.

The fuel injection drive unit 207*b* includes a switching element 305 and a shunt resistor 306. The switching element 305 is, for example, a transistor, and has a collector electrically connected to the fuel injection valve 105, a base electrically connected to the drive IC 208, and an emitter electrically connected to the shunt resistor 306. The switching element 305 controls the supply of a current from the fuel injection valve 105 to the shunt resistor 306 based on a signal input from the drive IC 208 to the base. The shunt resistor 306 has one end electrically connected to the switching element 305 and the other end being grounded. The shunt resistor 306 senses a current flowing between resistors and outputs the current to the drive IC 208.

Based on the command from the control unit 200, the fuel injection drive unit 207*b* can apply a voltage, supplied from the fuel injection drive unit 207*a* to the fuel injection valve 105, to the fuel injection valve 105 when a signal for turning on the switching element 305 is input from the drive IC 208, and can perform desired current control of the fuel injection valve 105, which will be described later, by detecting a current consumed by the fuel injection valve 105 from the current flowing between the resistors of the shunt resistor 306. Incidentally, a method of driving the fuel injection valve 105 is not limited to the above example. For example, in a case where a fuel pressure is relatively low, a case where the high voltage generation unit 206 has failed, or the like, the battery voltage 209 may be supplied instead of the high voltage 210 at the time of opening the fuel injection valve 105.

Next, a configuration and an operation of the fuel injection valve 105 will be described in detail.

Figure 4:
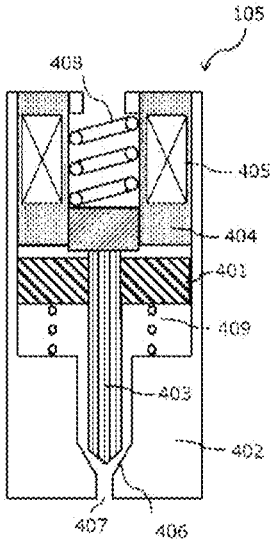
FIG. 4 is a configuration diagram of a fuel injection valve according to the embodiment.

FIG. 4 is a configuration diagram of the fuel injection valve according to the embodiment.

The fuel injection valve 105 includes: a cylindrical housing 402 having a valve seat 406 in which an opening (injection hole 407) for injection of fuel is formed; a valve body 403 that performs stroke movement (vertical movement) along a central axis of the housing 402; a movable core 401 formed to surround a periphery of the valve body 403; a fixed core 404 fixed inside the housing 402; and the solenoid 405 as an example of the coil that is wound around the fixed core 404 and generates a force for attracting the movable core 401.

A set spring 408, which biases the valve body 403 toward the valve seat 406 (downward in FIG. 4), is provided in an upper portion of the valve body 403. Further, a zero spring 409, which biases the movable core 401 upward, is provided between the movable core 401 and the housing 402.

In the fuel injection valve 105, when the internal space of the housing 402 is filled with fuel and a current flows through the solenoid 405, the movable core 401 is attracted toward the solenoid 405 by an attraction force of a magnetic flux by the solenoid 405, and a lower end of the valve body 403 is separated from the valve seat 406, whereby the internal fuel is injected from the injection hole 407 of the housing 402.

Thereafter, when the current supplied to the solenoid 405 becomes small and the attraction force becomes weak, the valve body 403 returns to an initial position (that is, position where the valve body 403 is in contact with the valve seat 406) where the zero spring 409 and the set spring 408 are balanced, thereby ending the fuel injection.

Next, an example of changes in an injection pulse, a drive voltage, and a drive current, and a displacement amount (valve displacement) of the valve body 403 when the fuel injection valve 105 is driven to inject fuel will be described.

Figure 5:
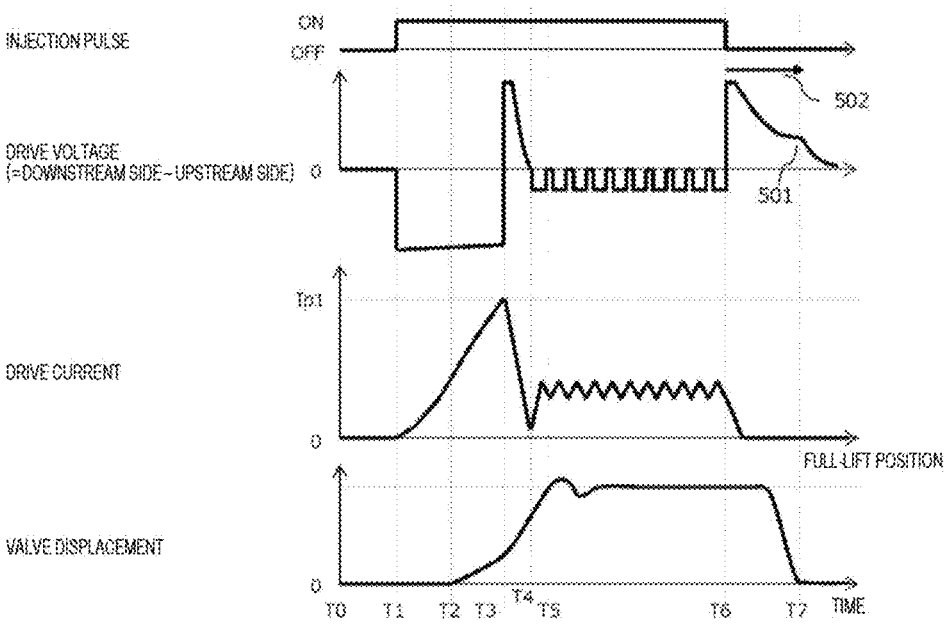
FIG. 5 is a view for describing a method of driving a fuel injection valve according to the embodiment.

FIG. 5 is a view for describing a method of driving the fuel injection valve according to the embodiment.

An injection pulse output from the pulse signal calculation unit 201 is in an off state, that is, a period in which the fuel injection control by the fuel injection valve 105 is not performed is formed between time points TO and T1, the fuel injection drive units 207*a* and 207*b* are in the off state so that a drive current is not supplied to the fuel injection valve 105. Therefore, the lower end of the valve body 403 is at a position of abutting on the valve seat 406 (valve displacement is zero) by a force of biasing the valve body 403 in a direction toward the valve seat 406 (valve closing direction) by a biasing force of the set spring 408 of the fuel injection valve 105, and thus, the injection hole 407 is closed so that fuel is not injected.

Next, when the injection pulse is turned on at the time point T1, the fuel injection drive unit (Hi) 207*a* and the fuel injection drive unit (Lo) 207*b* are turned on, and a portion between the high voltage generation unit 206 and the ground becomes conductive via the solenoid 405 of the fuel injection valve 105. As a result, a drive voltage of the high voltage 210 is applied to the solenoid 405, and the drive current starts to flow through the solenoid 405. As a result, a magnetic flux is generated between the fixed core 404 and the movable core 401 so that a magnetic attraction force acts on the movable core 401.

When the drive current supplied to the solenoid 405 increases and the magnetic attraction force acting on the movable core 401 exceeds the biasing force of the zero spring 409, the movable core 401 is attracted toward the fixed core 404 and starts moving (time points T1 to T2).

Thereafter, when an upper surface of the movable core 401 moves by a length that comes into contact with the upper portion of the valve body 403, the movable core 401 and the valve body 403 start moving integrally (time point T2). As a result, the valve body 403 is separated from the valve seat 406 to be open, and the injection of fuel from the injection hole 407 is started.

Thereafter, the movable core 401 and the valve body 403 integrally move until the movable core 401 comes into contact with the fixed core 404. Here, if the movable core 401 and the fixed core 402 vigorously collide with each other, the movable core 401 bounces back and moves downward due to the collision with the fixed core 402, so that a flow rate of the fuel injected from the injection hole 407 is disturbed. Therefore, in the present embodiment, the momentum of the movement of the movable core 401 and the valve body 403 is reduced (hereinafter, a period during which such control is performed is referred to as a FastFall period) by turning off the fuel injection drive units 207*a* and 207*b* and decreasing the drive voltage applied to the solenoid 405 to decrease the drive current at a time point (time point T3) before the movable core 401 comes into contact with the fixed core 404, for example, when the drive current reaches a peak current Ip1.

Thereafter, control (PMW control) for intermittently turning on the fuel injection drive unit (Hi) 207*a* in a state of maintaining the fuel injection drive unit (Lo) 207*b* in the on state is performed to intermittently set the drive voltage applied to the solenoid 405 to the battery voltage 209 in order to supply only the magnetic attraction force sufficient to attract the movable core 401 to the fixed core 404 from a time point T4 to a time point T6 at which the injection pulse falls, and control is performed such that the drive current flowing through the solenoid 405 falls within a predetermined range.

Since the injection pulse is turned off at the time point T6, all the fuel injection drive units 207*a* and 207*b* are turned off. As a result, the drive voltage applied to the solenoid 405 decreases and the drive current flowing through the solenoid 405 decreases after the time point T6. Thus, the magnetic flux generated between the fixed core 404 and the movable core 401 gradually disappears and the magnetic attraction force acting on the movable core 401 disappears. As a result, the valve body 403 is pushed back in the valve closing direction of the valve seat 406 with a predetermined time delay by the biasing force of the set spring 408 and a pressing force by a fuel pressure. Then, when the valve body 403 is returned to the original position as illustrated at a time point T7, the lower end of the valve body 403 abuts on the valve seat 406 to be closed, and the injection of the fuel from the injection hole 407 is ended.

Incidentally, a residual magnetic force in the fuel injection valve 105 may be quickly removed from the time point T6 at which the injection pulse is turned off, and the high voltage 210 may be supplied to the solenoid 405 in a reverse direction of that at the time of driving the fuel injection valve 105 such that the valve body 403 is closed early.

Next, configurations of the drive power input unit 211 and peripheral portions will be described.

Figure 6:
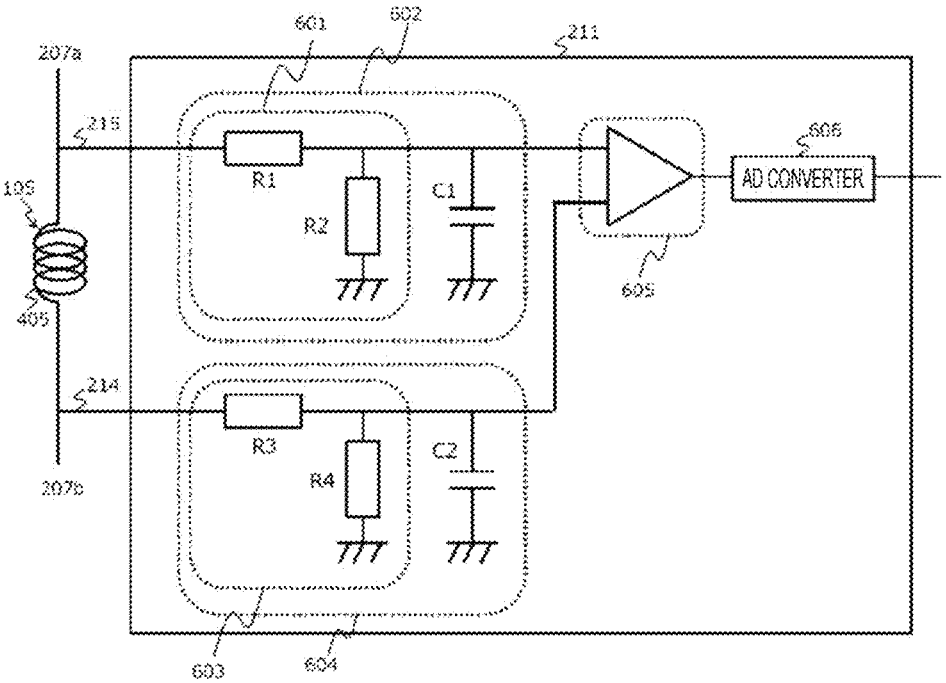
FIG. 6 is a configuration diagram of a drive power input unit and peripheral portions according to the embodiment.

FIG. 6 is a configuration diagram of the drive power input unit and peripheral portions according to the embodiment.

The drive voltage input unit 211 includes a voltage divider circuit 601,602, a differential circuit 605, and an AD converter 606.

The voltage divider circuit 601 is connected to the upstream side (positive terminal side) of the solenoid 405 of the fuel injection valve 105 via an electric wire 215, and divides and outputs the upstream voltage. In the present embodiment, the voltage divider circuit 601 includes voltage-dividing resistors R1 and R2. In the present embodiment, a capacitor C1 is connected to the voltage divider circuit 601 to form a low-pass filter 602. With the low-pass filter 602, divided voltages of an input voltage can be smoothed and output.

The voltage divider circuit 603 is connected to the downstream side (negative terminal side) of the solenoid 405 of the fuel injection valve 105 via an electric wire 214, and divides and outputs the downstream voltage. In the present embodiment, the voltage divider circuit 603 includes voltage-dividing resistors R3 and R4. Incidentally, a ratio of resistances of the voltage-dividing resistors R1 and R2 is the same as a ratio of resistances of the voltage-dividing resistors R3 and R4 in the present embodiment. In the present embodiment, a capacitor C2 is connected to the voltage divider circuit 603 to form a low-pass filter 604. With the low-pass filter 604, divided voltages of an input voltage can be smoothed and output.

Incidentally, the voltage divider circuits 601 and 603 are circuits configured to keep the upstream voltage and the downstream voltage of the solenoid 405 within a voltage range that can be processed by a subsequent circuit or the like, and the voltage divider circuits 601 and 603 are not necessarily provided as long as processing can be performed without voltage division.

The differential circuit 605 outputs a voltage (differential voltage) corresponding to a difference between divided voltages output from the voltage divider circuit 601 and the voltage divider circuit 603. Here, the differential voltage output from the differential circuit 605 has a predetermined relationship (here, a relationship corresponding to a voltage division ratio of the voltage divider circuits 601 and 603) with a differential voltage between the upstream voltage and the downstream voltage of the solenoid 405, and can be referred to as the voltage difference information based on the voltage difference between the upstream voltage and the downstream voltage.

The AD converter 606 performs digital conversion on the differential voltage output from the differential circuit 605 and outputs the converted differential voltage.

Incidentally, the configuration of the drive voltage input unit 211 is not limited to the configuration of FIG. 6. For example, the AD converter may perform digital conversion on each of voltages divided by the voltage divider circuits 601 and 603, apply a low-pass filter to such digitally converted data by software processing, and calculate a differential voltage from the obtained two voltages. Further, the differential voltage may be a difference between the downstream voltage of the fuel injection valve 105 and an installation voltage.

Next, processing of the fuel injection amount correction unit 213 will be described.

Figure 7:
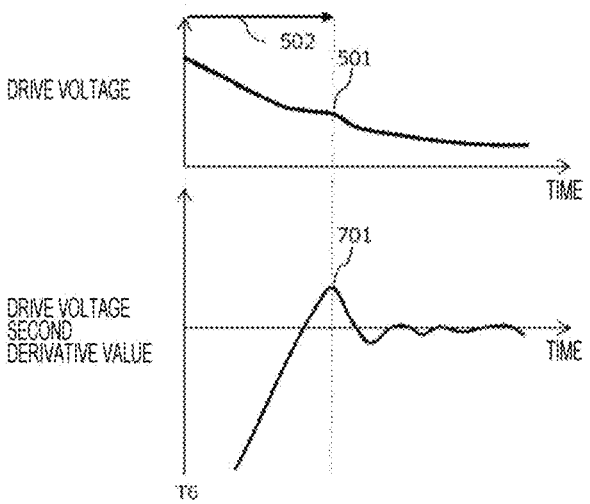
FIG. 7 is a view for describing a method of detecting an inflection point of a drive voltage according to the embodiment.

FIG. 7 is a view for describing a method of detecting an inflection point of a drive voltage according to the embodiment. FIG. 7 illustrates a graph illustrating a temporal change of the drive voltage and a graph illustrating a temporal change of a second-order differential value of the drive voltage. Incidentally, the drive voltage in FIG. 7 corresponds to the drive voltage after the time point T6 in FIG. 5.

When the valve body 403 of the fuel injection valve 105 is closed, the valve body 403 collides with the valve seat 406. When the valve body 403 collides with the valve seat 406 in this manner, the zero spring 409 transitions from extension to compression, a movement direction of the movable core 401 is reversed, the acceleration changes, and an inductance of the solenoid 405 changes. When the valve body 403 is closed, a drive current flowing through the solenoid 405 is cut off, a counter electromotive force is applied to the solenoid 405. If the drive current converges, the counter electromotive force also gradually decreases, and thus, an inflection point 501 is generated in the drive voltage as illustrated in FIG. 7 since the inductance changes when the counter electromotive force decreases.

In this manner, the inflection point of the drive voltage appearing when the valve is closed indicates a valve closing timing of the fuel injection valve 105. For this reason, a time 502 from the time point T6 at which the drive pulse is turned off to the inflection point 501 can be set as a valve closing completion time.

The inflection point 501 of the drive voltage appears as an extreme value (maximum value or minimum value) in a second-order differential value obtained by second-order differentiation of time-series data of the drive voltage applied to the solenoid 405. Therefore, the inflection point 501 can be appropriately identified by detecting an extreme value 701 of the time-series data of the drive voltage. Therefore, the fuel injection correction unit 213 detects the extreme value 701 using the second-order differential value of the time-series data of the drive voltage to identify the inflection point 501, and identifies the valve closing completion time 502.

Here, when the second-order differentiation is applied to the time-series data of the drive voltage from the time point T6 at which the injection pulse is turned off, the time at which a voltage is switched (for example, time at which the high voltage 210 is switched to the battery voltage 209 or time at which the counter electromotive force is applied after the drive voltage is turned off) is likely to appear as an extreme value, and there is a case where it is difficult to accurately identify an inflection point generated by a change in the acceleration of the movable core 401. Therefore, the time-series data to be subjected to the second-order differentiation is desirably time-series data of the drive voltage after a lapse of a predetermined time since the injection pulse is turned off (In other words, since the drive voltage is turned off). The predetermined time may be, for example, a time until there is no switching of the voltage since the injection pulse is turned off.

When sensing (identifying) of the valve closing completion time is completed, the fuel injection correction unit 213 compares the detected valve closing completion time with a valve closing completion time (reference valve closing completion time) serving as a reference stored in advance, and notifies the pulse signal calculation unit 201 and the drive waveform command unit 202 of an instruction for correcting the drive current so as to obtain an appropriate injection amount (which corresponds to an instruction for correcting a fuel injection amount). For example, when the detected valve closing completion time is longer than the reference valve closing completion time, the fuel injection correction unit 213 issues an instruction to decrease a peak current. When the peak current is decreased in this manner, a valve opening operation of the valve body can be delayed, and the fuel injection amount can be reduced to approximate a reference characteristic of a fuel injection valve. On the other hand, when the detected valve closing completion time is shorter than the reference valve closing completion time, the fuel correction unit 213 issues an instruction to increase the peak current. When the peak current is increased in this manner, a valve opening operation of the valve body can be accelerated, and the fuel injection amount can be increased to approximate the reference characteristic of the fuel injection valve.

The injection amount correction described above is performed based on the valve closing completion time detected based on the drive voltage (differential voltage) output from the drive voltage input unit 211. For this reason, if the drive voltage output from the drive voltage input unit 211 is an abnormal value, it is difficult to appropriately instruct the correction, and thus, it is difficult to inject an appropriate amount of fuel if the fuel injection is performed according to the correction instruction. Therefore, the fuel injection amount correction unit 213 issues the instruction to correct the fuel injection amount when the voltage input function abnormality detection unit 212 determines that the output of the drive voltage input unit 211 is not abnormal, that is, does not determine that a failure in which the output is abnormal has occurred, and stops instructing the correction of the fuel injection amount to stop the correction of the fuel injection amount when it is determined that the failure in which the output of the drive voltage input unit 211 is abnormal has occurred.

In this manner, it is possible to determine whether to correct the injection amount based on a determination result of the voltage input function abnormality detection unit 212, it is possible to appropriately prevent an unintended variation in the injection amount, and it is possible to prevent the deterioration in fuel consumption performance and exhaust performance.

Next, a processing operation of the voltage input function abnormality detection unit 212 will be described.

The voltage input function abnormality detection unit 212 determines whether the voltage difference information output from the drive voltage input unit 211 is normal.

When an abnormality occurs in the voltage difference information output from the drive voltage input unit 212, it is difficult to accurately detect the inflection point generated by the valve body operation of the fuel injection valve 105, that is, the generation timing of the extreme value from the abnormal voltage difference information although the fuel injection valve 105 is normally operated. As a result, the valve closing completion time detected by the fuel injection amount correction unit 213 becomes a time deviated from the actual valve body operation, and it is difficult to accurately correct the fuel injection amount, which may cause deterioration in fuel consumption and exhaust performance and an unintended torque variation.

For example, in a case where the voltage-dividing resistor R4 connected to the downstream side of the fuel injection valve 105 or the capacitor C2 used for the low-pass filter is short-circuited and connected to a ground voltage, a case where the electric wire 214 to which the voltage is input is disconnected, or the like, a failure (referred to as a downstream low-voltage failure) in which a measurement voltage on the downstream side becomes a low level occurs.

Further, in a case where a short circuit with an adjacent signal line (not illustrated), a short circuit with a signal line (not illustrated) such as a power supply system, a short circuit of the voltage-dividing resistor R3, or the like occurs, a failure (referred to as a downstream high-voltage failure) in which the measurement voltage on the downstream side becomes a high level occurs.

Further, the same applies to a voltage on the upstream side of the solenoid 405. In a case where the voltage-dividing resistor R1 or the capacitor C1 used for the low-pass filter is short-circuited and connected to the ground voltage, a case where the electric wire 215 to which the voltage is input is disconnected, or the like, a failure (upstream low-voltage failure) in which the measurement voltage on the upstream side becomes a low level occurs.

Further, in a case where a short circuit with an adjacent signal line (not illustrated), a short circuit with a signal line (not illustrated) such as a power supply system, a short circuit of the voltage-dividing resistor R1, or the like occurs, a failure (upstream high-voltage failure) in which the measurement voltage on the upstream side becomes a high level occurs.

Next, regarding a drive voltage (differential voltage), a correspondence relationship between the measurement voltage on the upstream side of the solenoid 405 and the measurement voltage on the downstream side at the time of the drive voltage in a normal state will be described.

Figure 8:
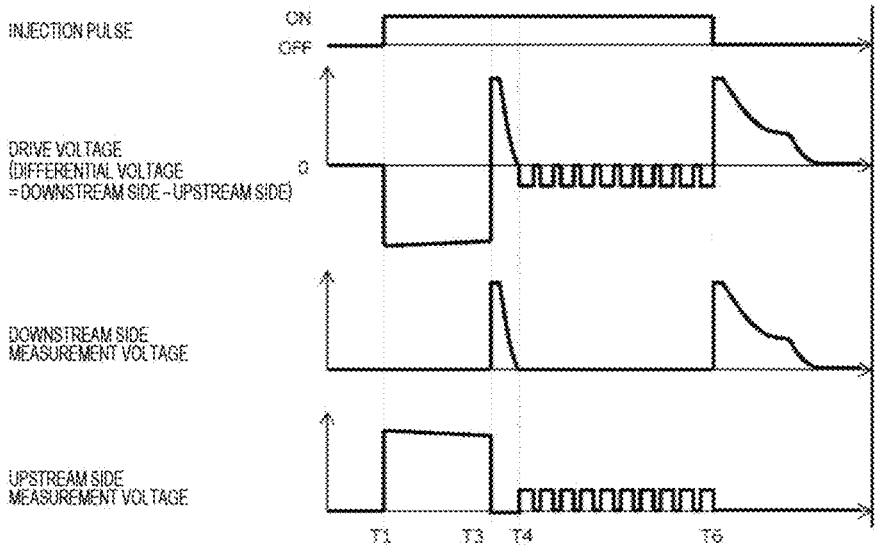
FIG. 8 is a view for describing a drive voltage according to the embodiment.

FIG. 8 is a view for describing a drive voltage according to the embodiment. The drive voltage illustrated in FIG. 8 corresponds to the drive voltage illustrated in FIG. 5.

The injection pulse is turned on at the time point T1, the fuel injection drive unit (Hi) 207*a* and the fuel injection drive unit (Lo) 207*b* are turned on, and a portion between the high voltage generation unit 206 and the ground becomes conductive via the solenoid 405 of the fuel injection valve 105. As a result, a drive voltage of the high voltage 210 is applied to the solenoid 405, and the drive current starts to flow through the solenoid 405.

At this time, the upstream side of the solenoid 405 of the fuel injection valve 105 has a high voltage, and the downstream side has a ground voltage.

At the time point T3 at which the drive current reaches the peak current Ip1, the fuel injection drive units 207*a* and 207*b* are turned off, and the high voltage 210 is supplied in the reverse direction. As a result, the drive voltage applied to the solenoid 405 decreases from the time point T3 to the time point T4. At this time, the upstream side of the solenoid 405 of the fuel injection valve 105 has the ground voltage, and the downstream side gradually decreases from the high voltage.

During a period from the time point T4 to the time point T6 when an injection pulse falls, the fuel injection drive unit (Hi) 207*a* is intermittently turned on in a state where the fuel injection drive unit (Lo) 207*b* is maintained in the on state to intermittently set the drive voltage applied to the solenoid 405 to the battery voltage 209, and control is performed such that the drive current flowing through the solenoid 405 falls within a predetermined range. At this time, the upstream side of the solenoid 405 of the fuel injection valve 105 repeatedly has any voltage between the battery voltage or the ground voltage, and the downstream side has the ground voltage.

When the injection pulse is turned off at the time point T6, all the fuel injection drive units 207*a* and 207*b* are turned off, the high voltage 210 is supplied in the reverse direction to that at the time of driving the fuel injection valve 105, and the drive voltage applied to the solenoid 405 decreases.

As described above, voltage behaviors on the upstream side and the downstream side change according to driving states of the fuel injection drive units 207*a* and 207*b*. For example, when the downstream low-voltage failure occurs, the measurement voltage on the downstream side becomes a low voltage, and thus, it is difficult to distinguish between the normality and failure between the time points T1 and T3 and the time points T4 and T6. Further, when the upstream high-voltage failure occurs, it is difficult to perform distinguishing between the time points T3 and T4 and after the time point T6.

Therefore, the voltage input function abnormality detection unit 212 of the present embodiment performs failure determination according to the driving states of the fuel injection drive units 207*a* and 207*b* regarding a failure that can be determined in such states.

Next, a failure detection method by the voltage input function abnormality detection unit 212 will be described. Incidentally, a differential voltage (drive voltage) will be described as a differential voltage based on a value obtained by subtracting an upstream voltage from a downstream voltage of the solenoid 405 of the fuel injection valve 105 in the present example. However, a failure can be similarly detected even when a differential voltage based on a value obtained by subtracting a downstream voltage from an upstream voltage of the fuel injection valve 105 is used.

First, a method of determining a downstream low-voltage failure after an injection pulse is turned off will be described.

Figure 9:
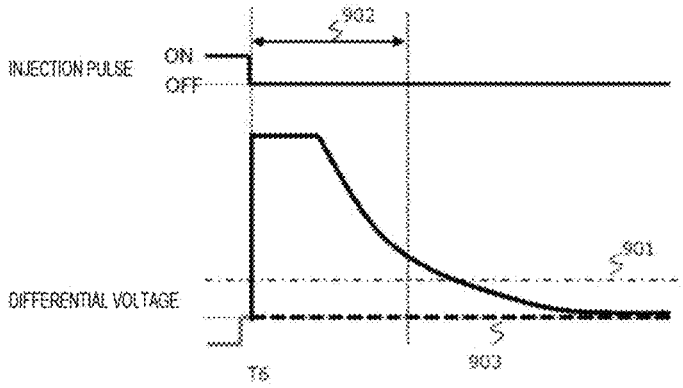
FIG. 9 is a view for describing a failure determination method for a downstream low-voltage failure according to the embodiment.

FIG. 9 is a view for describing a failure determination method for the downstream low-voltage failure according to the embodiment.

As described above, when the injection pulse is turned off at the time point T6, the drive current flowing through the solenoid 405 is cut off, the high voltage 210 is applied in the reverse direction of that at the time of the driving, and then, the drive voltage gradually decreases. That is, an upstream voltage of the solenoid 405 of the fuel injection valve 105 becomes a low voltage, a downstream voltage becomes a high voltage, and then, the downstream voltage gradually decreases. Eventually, there is no potential difference between the upstream voltage and the downstream voltage.

Meanwhile, when the downstream low-voltage failure occurs, a measurement voltage on the downstream side (downstream measurement voltage) measured by the drive voltage input unit 211 becomes a low voltage, so that a differential voltage between the downstream measurement voltage and an upstream measurement voltage is always a low voltage as indicated by a line 903. Therefore, the voltage input function abnormality detection unit 212 determines that there is a failure (abnormality: downstream low-voltage failure) when a differential voltage value after the injection pulse is turned off is not equal to or more than a threshold (downstream low-voltage failure determination threshold 901) which is a value more than a differential voltage value (voltage value indicated by the line 903) when an abnormality occurs. Further, the voltage input function abnormality detection unit 212 may determine that there is no failure when the differential voltage value after the injection pulse is turned off becomes equal to or more than the downstream low-voltage failure determination threshold 901.

However, the differential voltage between the upstream voltage and the downstream voltage decreases, and it becomes difficult to distinguish between the normality and failure if the time elapses after a reverse voltage is applied as described above. Thus, it is necessary to compare the differential voltage value with the downstream low-voltage failure determination threshold 901 to determine whether there is a failure at a time 902 before a time point at which the voltage becomes lower than the input unit downstream low-voltage failure determination threshold 901 even in the normal state after the injection pulse is turned off. Incidentally, the time 902 until the determination can be changed depending on which value the downstream low-voltage failure determination threshold 901 is set to. Further, as a fuel pressure when the injection pulse is turned off is smaller, a variation of the drive voltage becomes gentler, and thus, the time until the determination may be changed according to a fuel pressure value. That is, the time until the determination may be shortened as the fuel pressure is higher.

Incidentally, the differential voltage value output from the drive voltage input unit 211 is the differential voltage value of the divided voltage in the example illustrated in the present embodiment, and thus, the downstream low-voltage failure determination threshold 901 needs to be a threshold corresponding to a divided differential voltage value. However, a specific value varies depending on whether the differential voltage value is the divided differential voltage value or an undivided differential voltage value, but similar processing is performed, and thus, the undivided differential voltage value will be used for convenience in the following description of a failure determination method. Incidentally, processing using the undivided differential voltage value or threshold will be described, but the differential voltage value may be replaced with a divided differential voltage value and the threshold may be replaced with a divided threshold for a differential voltage in a case of using the divided differential voltage value.

Incidentally, the differential voltage value is compared with the downstream low-voltage failure determination threshold 901 to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described with reference to FIG. 9, in the fuel injection control device 127, the voltage difference information is the voltage difference information (divided differential voltage value) based on the voltage difference obtained by subtracting the upstream voltage from the downstream voltage, the threshold is a lower threshold (downstream low-voltage failure determination threshold 901) that the voltage difference information is assumed to be equal to or more than when an output of a voltage measurement unit (drive voltage input unit 211) is normal at a predetermined time point (any time point in the time 902), and the abnormality detection unit (voltage input function abnormality detection unit 212) determines that the output of the voltage measurement unit is abnormal when the voltage difference information output from the voltage measurement unit at the predetermined time point is not equal to or more than the lower threshold. As a result, the downstream low-voltage failure can be appropriately detected.

Next, a method of determining a downstream high-voltage failure after an injection pulse is turned off will be described.

Figure 10:
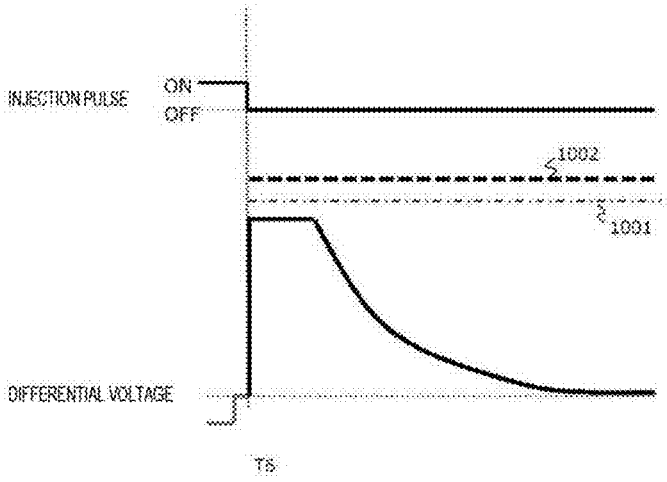
FIG. 10 is a view for describing a failure determination method for a downstream high-voltage failure according to the embodiment.

FIG. 10 is a view for describing a failure determination method for the downstream high-voltage failure according to the embodiment.

When the downstream high-voltage failure occurs, a downstream measurement voltage becomes a high voltage, and an upstream measurement voltage is a low voltage after the injection pulse is turned off, so that a differential voltage between the downstream measurement voltage and the upstream measurement voltage always becomes a high voltage as indicated by a line 1002. Therefore, the voltage input function abnormality detection unit 212 determines that there is a failure (downstream high-voltage failure) when the differential voltage does not become equal to or less than a threshold (downstream high-voltage failure determination threshold 1001) which is a value lower than the differential voltage value (voltage value indicated by the line 1002) when the abnormality occurs after the injection pulse is turned off. Further, the voltage input function abnormality detection unit 212 may determine that there is no failure when the differential voltage after the injection pulse is turned off becomes equal to or less than the downstream high-voltage failure determination threshold 1001.

Incidentally, the differential voltage value is compared with the downstream high-voltage failure determination threshold 1001 to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described with reference to FIG. 10, in the fuel injection control device 127, the voltage difference information is the voltage difference information (divided differential voltage value) based on the voltage difference obtained by subtracting the upstream voltage from the downstream voltage, the threshold is an upper threshold (downstream high-voltage failure determination threshold 1001) that the voltage difference information is assumed to be equal to or less than when the output of the voltage measurement unit (drive voltage input unit 211) is normal at a predetermined time point, and the abnormality detection unit (voltage input function abnormality detection unit 212) determines that the output of the voltage measurement unit is abnormal when the voltage difference information output from the voltage measurement unit at the predetermined time point is not equal to or less than the upper threshold. As a result, the downstream high-voltage failure can be appropriately detected.

Next, a method of determining an upstream high-voltage failure after an injection pulse is turned off will be described.

Figure 11:
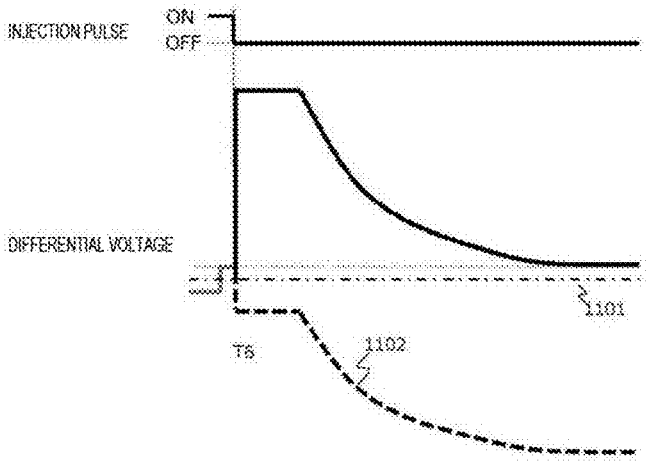
FIG. 11 is a view for describing a failure determination method for an upstream high-voltage failure according to the embodiment.

FIG. 11 is a view for describing a failure determination method for the upstream high-voltage failure according to the embodiment.

When the upstream high-voltage failure occurs, an upstream voltage becomes a high voltage after the injection pulse is turned off, and a differential voltage measured by the drive voltage input unit 211 becomes a low voltage as indicated by a line 1102. At this time, the differential voltage becomes a negative voltage when the maximum measurable voltage is set to be larger than the high voltage 210 applied in the reverse direction to the downstream side. Therefore, the voltage input function abnormality detection unit 212 determines that there is a failure (upstream high-voltage failure) when the differential voltage does not become equal to or more than a threshold (upstream high-voltage failure determination threshold 1101) which is a value higher than the differential voltage value (line 1102) when the abnormality occurs after the injection pulse is turned off.

Incidentally, the upstream high-voltage failure determination threshold 1101 may be the same value as the downstream low-voltage failure determination threshold 901 illustrated in FIG. 9. Here, if the upstream high-voltage failure determination threshold 1101 is set to be relatively smaller than the downstream low-voltage failure determination threshold 901, it may be possible to distinguish between the upstream high-voltage failure and the downstream low-voltage failure.

Further, the voltage input function abnormality detection unit 212 may determine that there is no failure when the differential voltage value after the injection pulse is turned off becomes equal to or more than the upstream high-voltage failure determination threshold 1101.

Incidentally, the differential voltage value is compared with the upstream high-voltage failure determination threshold 1101 to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

Next, a method of determining an upstream low-voltage failure will be described.

Figure 12:
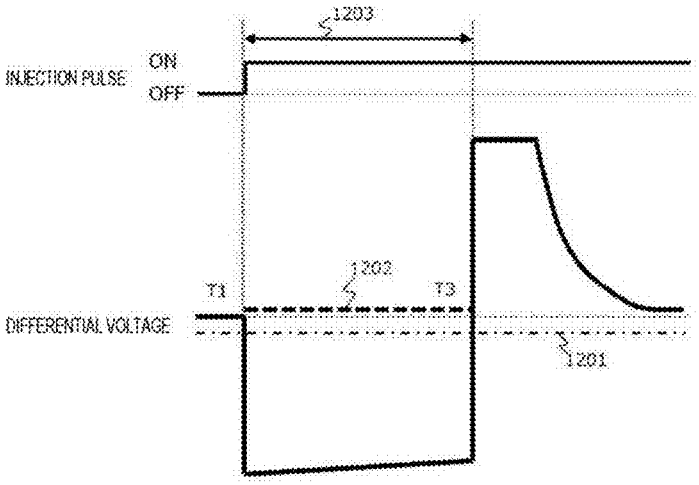
FIG. 12 is a view for describing a failure determination method for an upstream low-voltage failure according to the embodiment.

FIG. 12 is a view for describing a failure determination method for the upstream low-voltage failure according to the embodiment.

When the upstream low-voltage failure occurs, an upstream measurement voltage measured by the drive voltage input unit 211 becomes a low voltage. Meanwhile, an upstream voltage becomes a low voltage when the injection pulse is turned off. For this reason, when the injection pulse is turned off, it is difficult to distinguish whether there is the upstream low-voltage failure from a differential voltage. Therefore, the voltage input function abnormality detection unit 212 determines the upstream low-voltage failure in the on state of the injection pulse where the upstream voltage becomes a high voltage.

Although the upstream voltage becomes a high voltage after the injection pulse is turned on, the upstream measurement voltage measured by the drive voltage input unit 211 becomes a low voltage if the upstream low-voltage failure occurs, and the differential voltage between a downstream measurement voltage and the upstream measurement voltage is always zero as indicated by a line 1202. Therefore, the voltage input function abnormality detection unit 212 determines that there is a failure (upstream low-voltage failure) when the differential voltage during a period 1203 from the time point T1 at which the injection pulse is turned on to the time point T3 does not become equal to or less than a threshold (upstream low-voltage failure determination threshold 1201) which is a value lower than the differential voltage value (line 1202) when an abnormality occurs. Incidentally, the period 1203 can be calculated in advance by an experiment or the like. Alternatively, it may be determined that there is a failure (upstream low-voltage failure) when the differential voltage does not become equal to or less than the upstream low-voltage failure determination threshold 1201 during a period in which the switching element 303 on the high voltage side is turned on, instead of the period 1203. Further, the voltage input function abnormality detection unit 212 may determine that there is no failure when the differential voltage output from the drive voltage input unit 211 after the injection pulse is turned on becomes equal to or less than the upstream low-voltage failure determination threshold 1201.

Incidentally, the differential voltage value is compared with the upstream low-voltage failure determination threshold 1201 to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described with reference to FIG. 12, in the fuel injection control device 127, the voltage difference information is the voltage difference information based on the voltage difference obtained by subtracting the upstream voltage from the downstream voltage, and the abnormality detection unit determines that the output of the voltage measurement unit is abnormal (the upstream low-voltage failure) when voltage difference information, output from the voltage measurement unit (drive voltage input unit 212) at a supply time point of the second voltage during a control period (period in which the injection pulse is turned on) of voltage supply by the first voltage supply unit and the second voltage supply unit for the valve opening control of the fuel injection valve, does not become equal to or less than the threshold (upstream low-voltage failure determination threshold 1201) that the voltage difference information is assumed to be equal to or less than when the voltage measurement unit is normal at the supply time point (time point T1 to time point T3) of the second voltage during the control period. As a result, the upstream low-voltage failure can be appropriately detected.

Next, a method of determining a failure during the FastFall period will be described.

Figure 13:
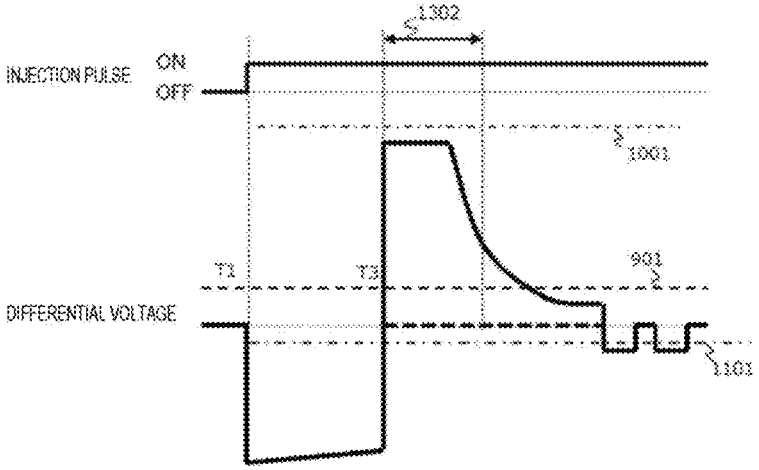
FIG. 13 is a view for describing a failure determination method during a FastFall period according to the embodiment.

FIG. 13 is a view for describing the failure determination method during the FastFall period according to the embodiment.

During the FastFall period after energization of a peak current (after the time point T3), a downstream high-voltage failure, a downstream low-voltage failure, and an upstream high-voltage failure can be determined. During the FastFall period, the switching element 303 on the high voltage side, the switching element 304 on the low voltage side, and the switching element 305 on the downstream side are turned off similarly to a period after the injection pulse is turned off, and the high voltage 210 is applied to the solenoid 405 in the reverse direction of that at the time of the driving. Thus, a downstream voltage becomes a high voltage and an upstream voltage becomes a low voltage. Therefore, the voltage input function abnormality detection unit 212 performs failure determination based on a differential voltage during a predetermined period 1302 after the time point T3 at which the switching element 303 on the high voltage side, the switching element 304 on the low voltage side, and the switching element 305 on the downstream side are turned off.

For example, when the differential voltage during the period 1302 does not become equal to or more than the downstream low-voltage failure threshold 901, the voltage input function abnormality detection unit 212 determines that the downstream low-voltage failure occurs. Further, the voltage input function abnormality detection unit 212 determines that the downstream high-voltage failure occurs when the differential voltage during the period 1302 does not become equal to or less than the downstream high-voltage failure threshold 1001. Further, the voltage input function abnormality detection unit 212 determines that the upstream high-voltage failure occurs when the differential voltage during the period 1302 does not become equal to or more than the upstream high-voltage failure threshold 1101.

The voltage input function abnormality detection unit 212 may determine that there is no failure when the differential voltage is equal to or more than the downstream low-voltage failure threshold 901, equal to or less than the downstream high-voltage failure threshold 1001, or equal to or more than the upstream high-voltage failure threshold 1101.

Incidentally, the differential voltage value is compared with the threshold to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described with reference to FIG. 13, in the fuel injection control device 127, the abnormality detection unit determines that the output of the voltage measurement unit is abnormal (the downstream low-voltage failure occurs) when voltage difference information, output from the voltage measurement unit at a supply stop time point (period 1302) of the first voltage and the second voltage during a control period (period in which the injection pulse is set to ON) of the voltage supply by the first voltage supply unit and the second voltage supply unit for the valve opening control of the fuel injection valve, does not become equal to or more than the threshold (downstream low-voltage failure threshold 901) that the voltage difference information is assumed to be equal to or more than when the voltage measurement unit is normal at the supply stop time point of the first voltage and the second voltage during the control period, and determines that the output of the voltage measurement unit is abnormal (the downstream high-voltage failure occurs) when the voltage difference information does not become equal to or less than the threshold (downstream high-voltage failure threshold 1001) that the voltage difference information is assumed to be equal to or less than when the voltage measurement unit is normal at the supply stop time point of the first voltage and the second voltage during the control period. As a result, the downstream low-voltage failure and the downstream high-voltage failure can be appropriately detected.

Next, a method of determining a failure during energization of a holding current will be described.

Figure 14:
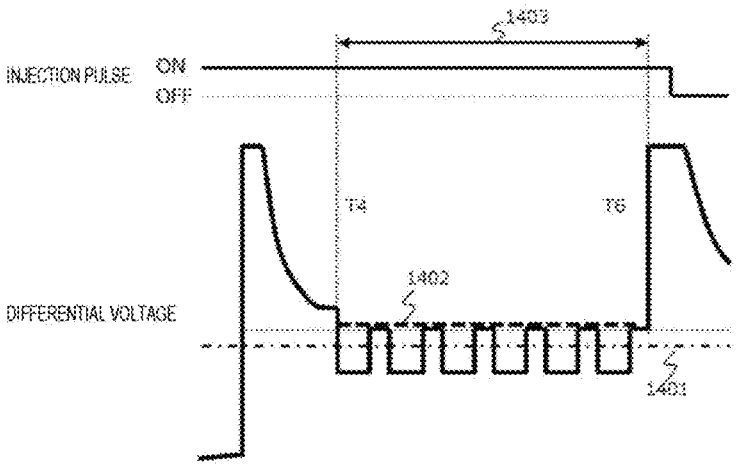
FIG. 14 is a view for describing a failure determination method during energization of a holding current according to the embodiment.

FIG. 14 is a view for describing the failure determination method during energization of the holding current according to the embodiment.

An upstream low-voltage failure can also be implemented during energization of the holding current while the injection pulse is turned on.

A period during energization of the holding current corresponds to a period from the time point T4 to the time point T6 illustrated in FIG. 8. During the holding current energization period, the switching element 304 on the low voltage side is controlled to be repeatedly turned on and off. When the switching element 304 on the low voltage side is turned on, an upstream voltage increases to a level corresponding to the battery voltage. On the other hand, when the switching element 304 on the low voltage side is turned off, the switching element 305 on the downstream side remains on, and thus, a downstream voltage becomes the ground voltage.

For this reason, it is difficult to determine the upstream low-voltage failure since a differential voltage becomes zero when the switching element 304 on the low voltage side is turned off. However, when the switching element 304 on the low voltage side is turned on, the differential voltage becomes high, and thus, it is possible to determine the upstream low-voltage failure.

When the upstream low-voltage failure occurs, the differential voltage between a downstream measurement voltage and an upstream measurement voltage is always zero as indicated by a line 1402. Therefore, the voltage input function abnormality detection unit 212 determines that the upstream low-voltage failure occurs when the differential voltage does not become equal to or less than a threshold (upstream low-voltage failure determination threshold 1401) which is a value lower than the differential voltage value (line 1402) when an abnormality occurs. Further, the voltage input function abnormality detection unit 212 may determine that there is no failure when the differential voltage during energization of the holding current becomes equal to or less than the upstream low-voltage failure determination threshold 1401.

As described with reference to FIG. 14, in the fuel injection control device 127, the abnormality detection unit determines that the output of the voltage measurement unit is abnormal when voltage difference information, output from the voltage measurement unit at a supply time point of the first voltage during a control period (period in which the injection pulse is set to ON) of the voltage supply by the first voltage supply unit and the second voltage supply unit for the valve opening control of the fuel injection valve, does not become equal to or less than a threshold (upstream low-voltage failure determination threshold 1401) that the voltage difference information is assumed to be equal to or less than when the voltage measurement unit is normal at the supply time point of the first voltage during the control period. As a result, the upstream low-voltage failure can be appropriately detected.

Since the behavior of the differential voltage varies depending on the driving state as described above, it is possible to identify a failure cause (for example, a failure point) by measuring the differential voltage until the injection pulse is turned off at the time point T6 and then the high voltage 210 applied in the reverse direction converges since the injection pulse is turned on at the time point T1, and performing failure diagnosis according to the driving state.

An example of a series of processes of the failure diagnosis according to the driving state will described with reference to FIG. 8.

The voltage input function abnormality detection unit 212 determines an upstream low-voltage failure during a period from the time point (time point T1) at which the injection pulse is turned on to the time point (time point T3) at which the peak current is supplied.

Next, the voltage input function abnormality detection unit 212 determines a downstream low-voltage failure, a downstream high-voltage failure, and an upstream high-voltage failure during a period from the time point (time point T3) at which the peak current is supplied to the time point (time point T4) at which the supply of the holding current is started. As described above, it is possible to determine a form (type) of the failure by using different thresholds to determine the respective failures.

During a period from the time point T4 to the time point T6, the voltage input function abnormality detection unit 212 determines the upstream low-voltage failure similarly to the period from the time point T1 to the time point T3.

Next, the voltage input function abnormality detection unit 212 determines the downstream low-voltage failure, the downstream high-voltage failure, and the upstream high-voltage failure after the time point T6 at which the injection pulse is turned off.

Since all the failures can be determined by observing the differential voltage in one injection operation by executing such a series of processes, it is possible to determine the failure with high frequency and appropriately determine the form of the failure.

Incidentally, the voltage input function abnormality detection unit 212 may determine the downstream high-voltage failure and the upstream high-voltage failure during the period from the time point T1 to the time point T3. Further, the voltage input function abnormality detection unit 212 may determine the downstream high-voltage failure and the upstream high-voltage failure during the period from the time point T4 to the time point T6. Further, the voltage input function abnormality detection device 212 does not necessarily perform the entire failure determination described above, and may perform a part of the above-described failure determination.

Next, a description will be given regarding failure detection in a case where a configuration of the internal combustion engine system 100 is a configuration in which a leakage current is generated on the upstream side and the downstream side of the solenoid 405 of the fuel injection valve 105.

In the configuration in which the leakage current is generated on the upstream side and the downstream side of the solenoid 405 of the fuel injection valve 105, a downstream low-voltage failure, a downstream high-voltage failure, an upstream low-voltage failure, and an upstream high-voltage failure can be detected after the injection pulse is turned off or during the FastFall period in which the injection pulse is turned on.

Here, the leakage current will be described.

Figure 15:
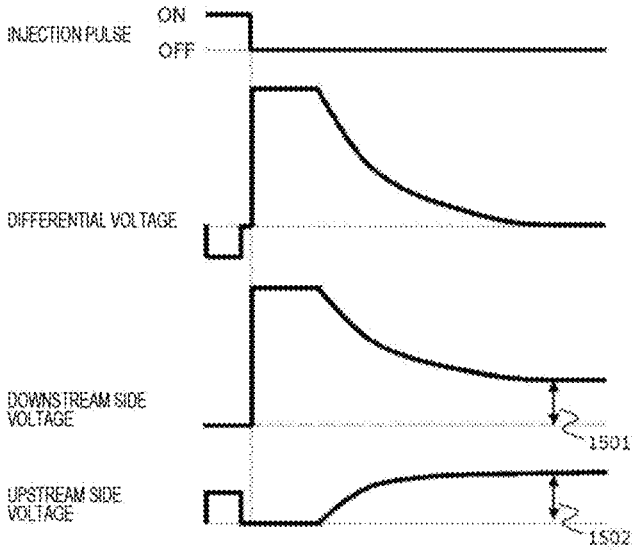
FIG. 15 is a view for describing a voltage change caused by a leakage current according to the embodiment.

FIG. 15 is a view for describing a voltage change caused by the leakage current according to the embodiment.

The leakage current flows into the solenoid 405 of the fuel injection valve 105 from an input side of the switching element 303 on the high voltage side or the switching element 304 on the low voltage side. Therefore, an upstream voltage and a downstream voltage of the solenoid 405 of the fuel injection valve 105 increase by increase voltages 1502 and 1501, respectively, in a state where the switching element 303, 304, and 305 are turned off.

Since the height of the increase voltage is the same on the upstream side and the downstream side, a differential voltage obtained by subtracting an upstream measurement voltage from a downstream measurement voltage is not affected by the voltage change caused by the leakage current. However, in a case where the drive voltage input unit 211 fails or the like, the voltage change caused by the leakage current appears in the differential voltage, and thus, it is possible to identify a failure point based on the voltage change.

Next, a failure determination method for a downstream failure using the leakage current will be described.

Figure 16:
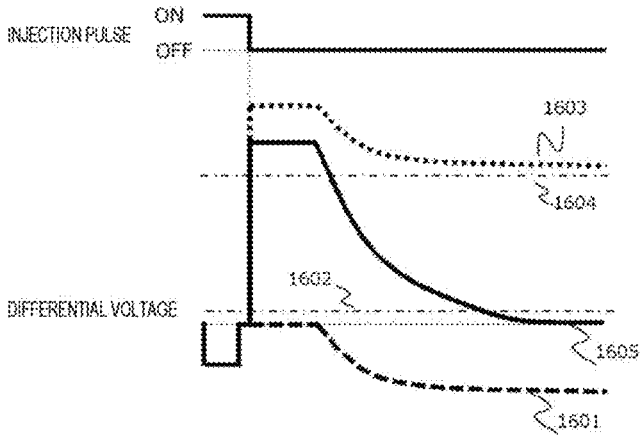
FIG. 16 is a view for describing a failure determination method for a downstream failure using a leakage current according to the embodiment.

FIG. 16 is a view for describing the failure determination method for the downstream failure using the leakage current according to the embodiment.

First, determination of a downstream low-voltage failure will be described. After the injection pulse is turned off, a downstream measurement voltage becomes a low voltage if the downstream low-voltage failure occurs. As a result, a differential voltage becomes a voltage indicated by a line 1601. Therefore, the voltage input function abnormality detection unit 212 determines that the downstream low-voltage failure occurs when the differential voltage after the injection pulse is turned off does not become equal to or more than a downstream low-voltage failure determination threshold 1602 having a value higher than the voltage indicated by the line 1601. Further, the voltage input function abnormality detection unit 212 may determine that there is no failure when the differential voltage becomes equal to or more than the downstream low-voltage failure determination threshold 1602.

Incidentally, the differential voltage value is compared with the threshold to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described above, in the fuel injection control device 127, the abnormality detection unit determines that the output of the voltage measurement unit is abnormal (the downstream low-voltage failure) when voltage difference information, output from the voltage measurement unit at a predetermined time point after a control period (period in which the injection pulse is turned on) of voltage supply by the first voltage supply unit and the second voltage supply unit for the valve opening control of the fuel injection valve, does not become equal to or more than the threshold (downstream low-voltage failure determination threshold 1602) that the voltage difference information is assumed to be equal to or more than when the voltage measurement unit is normal at the predetermined time point. As a result, the downstream low-voltage failure can be appropriately detected.

Next, determination of a downstream high-voltage failure will be described. When the downstream high-voltage failure occurs, a differential voltage becomes the high voltage side, but a differential voltage when the downstream high-voltage failure occurs decreases from a voltage value of the high voltage by a voltage change due to a leakage current as indicated by a line 1603 since the voltage change occurs on the upstream side due to the leakage current. Therefore, the voltage input function abnormality detection unit 212 determines that the downstream high-voltage failure occurs when the differential voltage does not become equal to or less than a downstream high-voltage failure determination threshold 1604 which is lower than the voltage value indicated by the line 1603. Further, the voltage input function abnormality detection unit 212 may determine that there is no failure when the differential voltage becomes equal to or less than the downstream high-voltage failure determination threshold 1604.

Incidentally, the differential voltage value is compared with the threshold to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

As described above, in the fuel injection control device 127, the abnormality detection unit determines that the output of the voltage measurement unit is abnormal when voltage difference information, output from the voltage measurement unit at a predetermined time point after a control period (period in which the injection pulse is turned on) of voltage supply by the first voltage supply unit and the second voltage supply unit for the valve opening control of the fuel injection valve, does not become equal to or less than the threshold (downstream high-voltage failure determination threshold 1604) that the voltage difference information is assumed to be equal to or less than when the voltage measurement unit is normal at the predetermined time point. As a result, the downstream high-voltage failure can be appropriately detected.

Next, a failure determination method for an upstream failure using the leakage current will be described.

Figure 17:
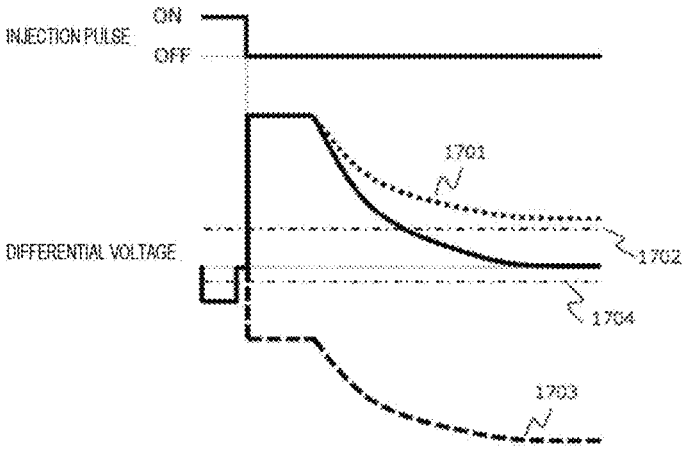
FIG. 17 is a view for describing a failure determination method for an upstream failure using a leakage current according to the embodiment.

FIG. 17 is a view for describing the failure determination method for the upstream failure using the leakage current according to the embodiment.

First, determination of an upstream low-voltage failure will be described. When the upstream low-voltage failure occurs, an upstream measurement voltage becomes a low voltage, so that a differential voltage becomes higher than a normal differential voltage by a voltage increase due to a leakage current as indicated by a line 1701. Therefore, the voltage input function abnormality detection unit 212 determines that the upstream low-voltage failure occurs when the differential voltage after the injection pulse is turned off does not become equal to or less than an upstream low-voltage failure determination threshold 1702 having a value lower than the voltage value indicated by the line 1701. Further, the voltage input function abnormality detection unit 212 may determine that there is no failure when the differential voltage becomes equal to or less than the upstream low-voltage failure determination threshold 1702.

Incidentally, the differential voltage value is compared with the threshold to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

Next, determination of an upstream high-voltage failure will be described. When the upstream high-voltage failure occurs, an upstream measurement voltage becomes a high voltage, and thus, a differential voltage becomes a negative voltage, but becomes higher by a voltage increase due to a leakage current as indicated by a line 1703 since a downstream voltage increases due to the leakage current. Therefore, the voltage input function abnormality detection unit 212 determines that the upstream high-voltage failure occurs when the differential voltage after the injection pulse is turned off does not become equal to or more than an upstream high-voltage failure determination threshold 1704 having a value higher than the voltage value indicated by the line 1703. Further, the voltage input function abnormality detection unit 212 may determine that there is no failure when the differential voltage becomes equal to or more than the upstream high-voltage failure determination threshold 1704.

Incidentally, the differential voltage value is compared with the threshold to perform the failure determination in the above example. For example, a differential voltage value in a normal state (normal differential voltage value) may be measured in advance, and then, it may be determined that there is a failure when a difference between a measured differential voltage value and the normal differential voltage value becomes equal to or larger than a certain value, and it may be determined that there is no failure when the difference is not equal to or larger than the certain value.

When the voltage affected by the leakage current is used in this manner, it is possible to detect a failure regarding the differential voltage after the injection pulse is turned off, it is possible to distinguish a type of the failure, and it is possible to simplify the failure diagnosis logic.

As described above, the fuel injection control device 127 according to the present embodiment is the fuel injection control device 127 including: the first voltage supply unit (fuel injection drive unit 207*a*) that supplies the first voltage (low voltage); the second voltage supply unit (fuel injection drive unit 207*a*) that supplies the second voltage (high voltage) higher than the first voltage; and a fuel injection control unit (the drive IC 208 and the control unit 200) that controls the second voltage supply unit to supply the second voltage to the coil so as to open the fuel injection valve 105 including the coil (solenoid 405) and controls the first voltage supply unit to supply the first voltage to the coil so as to hold the valve-open state of the fuel injection valve 105, and includes: the voltage measurement unit (drive voltage input unit 211) that measures and outputs voltage information based on the upstream voltage of the coil of the fuel injection valve and the downstream voltage of the coil; a correction unit (the fuel injection amount correction unit 213) that corrects the fuel injection amount of the fuel injection valve based on the voltage information output from the voltage measurement unit; and an abnormality detection unit (the voltage input function abnormality detection unit 212) that detects whether the output of the voltage measurement unit is abnormal based on the voltage information output from the voltage measurement unit.

With this configuration, it is possible to appropriately detect the abnormality of the voltage information output from the voltage measurement unit, which is the basis for correcting the fuel injection amount.

Incidentally, the present invention is not limited to the above-described embodiment, and can be appropriately modified and implemented within a range not departing from a spirit of the present invention.

For example, control lines and information lines are considered to be necessary for the description have been illustrated in the above embodiment, and it is difficult to say that all of the control lines and information lines required as a product are illustrated. It may be considered that most of the configurations are practically connected to each other.

Further, when detecting that there is an abnormality in the output of the drive voltage input unit 211 in the above embodiment, the voltage input function abnormality detection unit 212 may store information (for example, a type of a failure) indicating the abnormality in a storage device (not illustrated) inside the ECU 109. In this case, the information indicating the abnormality stored in the storage device may be read from an inspection device connected to the ECU 109 at the time of inspecting a vehicle, for example, and displayed on the inspection device. Then, it is possible to grasp that there is an abnormality in the output of the drive voltage input unit 211 from the information indicating the abnormality of the storage device.

Further, some or all of the processes performed by the microcomputer constituting the control unit 200 in the above embodiment may be performed by another hardware circuit.

REFERENCE SIGNS LIST

100 internal combustion engine system
101 engine

105 fuel injection valve
109 ECU
127 fuel injection control device
200 control unit
201 pulse signal calculation unit
202 drive waveform command unit
207*a* fuel injection drive unit
211 drive voltage input unit
212 voltage input function abnormality detection unit
213 fuel injection amount correction unit
405 solenoid

The invention claimed is:

1. A fuel injection control device comprising:

a first voltage supply unit that supplies a first voltage;

a second voltage supply unit that supplies a second voltage higher than the first voltage;

a fuel injection control unit that controls the second voltage supply unit to supply the second voltage to a coil so as to open a fuel injection valve having the coil, and controls the first voltage supply unit to supply the first voltage to the coil so as to hold a valve-open state of the fuel injection valve;

a voltage measurement unit that measures and outputs voltage information based on an upstream voltage of the coil of the fuel injection valve and a downstream voltage of the coil;

a correction unit that corrects a fuel injection amount of the fuel injection valve based on the voltage information output from the voltage measurement unit; and an abnormality detection unit that detects whether an output of the voltage measurement unit is abnormal based on the voltage information output from the voltage measurement unit.

2. The fuel injection control device according to claim 1, wherein the voltage information is voltage difference information based on a voltage difference between the upstream voltage and the downstream voltage.

3. The fuel injection control device according to claim 2, wherein the abnormality detection unit compares voltage difference information, output from the voltage measurement unit at a predetermined time point after end of a control period of voltage supply by the first voltage supply unit and the second voltage supply unit for valve opening control of the fuel injection valve, and a predetermined threshold related to the voltage difference information for determining whether a predetermined output of the voltage measurement unit is abnormal at the predetermined time point, and determines whether the output of the voltage measurement unit is abnormal based on a comparison result.

4. The fuel injection control device according to claim 3, wherein the voltage difference information is voltage difference information based on a voltage difference obtained by subtracting the upstream voltage from the downstream voltage, the threshold is a lower threshold that the voltage difference information is assumed to be equal or more than when the output of the voltage measurement unit is normal at the predetermined time point, and the abnormality detection unit determines that the output of the voltage measurement unit is abnormal when the voltage difference information output from the voltage measurement unit at the predetermined time point is not equal to or more than the lower threshold.

5. The fuel injection control device according to claim 3, wherein the voltage difference information is voltage difference information based on a voltage difference obtained by subtracting the upstream voltage from the downstream voltage, the threshold is an upper threshold that the voltage difference information is assumed to be equal or less than when the output of the voltage measurement unit is normal at the predetermined time point, and the abnormality detection unit determines that the output of the voltage measurement unit is abnormal when the voltage difference information output from the voltage measurement unit at the predetermined time point is not equal to or less than the upper threshold.

6. The fuel injection control device according to claim 2, wherein the voltage difference information is voltage difference information based on a voltage difference obtained by subtracting the upstream voltage from the downstream voltage, and the abnormality detection unit determines that the output of the voltage measurement unit is abnormal when voltage difference information, output from the voltage measurement unit at a supply time point of the second voltage during a control period of voltage supply by the first voltage supply unit and the second voltage supply unit for valve opening control of the fuel injection valve, does not become equal to or less than a threshold that the voltage difference information is assumed to be equal to or less than when the voltage measurement unit is normal at the supply time point of the second voltage during the control period.

7. The fuel injection control device according to claim 2, wherein the voltage difference information is voltage difference information based on a voltage difference obtained by subtracting the upstream voltage from the downstream voltage, and the abnormality detection unit determines that the output of the voltage measurement unit is abnormal when voltage difference information, output from the voltage measurement unit at a supply stop time point of the first voltage and the second voltage during a control period of voltage supply by the first voltage supply unit and the second voltage supply unit for valve opening control of the fuel injection valve, does not become equal to or more than a threshold that the voltage difference information is assumed to be equal to or more than when the voltage measurement unit is normal at the supply stop time point of the first voltage and the second voltage during the control period.

8. The fuel injection control device according to claim 2, wherein the voltage difference information is voltage difference information based on a voltage difference obtained by subtracting the upstream voltage from the downstream voltage, and the abnormality detection unit determines that the output of the voltage measurement unit is abnormal when voltage difference information, output from the voltage measurement unit at a supply stop time point of the first voltage and the second voltage during a control period of voltage supply by the first voltage supply unit and the second voltage supply unit for valve opening control of the fuel injection valve, does not become equal to or less than a threshold that the voltage difference information is assumed to be equal to or less than when the voltage measurement unit is normal at the supply stop time point of the first voltage and the second voltage during the control period.

9. The fuel injection control device according to claim 2, wherein the voltage difference information is voltage difference information based on a voltage difference obtained by subtracting the upstream voltage from the downstream voltage, and the abnormality detection unit determines that the output of the voltage measurement unit is abnormal when voltage difference information, output from the voltage measurement unit at a supply time point of the first voltage during a control period of voltage supply by the first voltage supply unit and the second voltage supply unit for valve opening control of the fuel injection valve, does not become equal to or less than a threshold that the voltage difference information is assumed to be equal to or less than when the voltage measurement unit is normal at the supply time point of the first voltage during the control period.

10. The fuel injection control device according to claim 2, wherein the voltage difference information is voltage difference information based on a voltage difference obtained by subtracting the upstream voltage from the downstream voltage, a leakage current flows into an upstream side and a downstream side of the coil, and the abnormality detection unit determines that the output of the voltage measurement unit is abnormal when voltage difference information, output from the voltage measurement unit at a predetermined time point after a control period of voltage supply by the first voltage supply unit and the second voltage supply unit for valve opening control of the fuel injection valve, does not become equal to or more than a threshold that the voltage difference information is assumed to be equal to or more than when the voltage measurement unit is normal at the predetermined time point.

11. The fuel injection control device according to claim 2, wherein the voltage difference information is voltage difference information based on a voltage difference obtained by subtracting the upstream voltage from the downstream voltage, a leakage current flows into an upstream side and a downstream side of the coil, and the abnormality detection unit determines that the output of the voltage measurement unit is abnormal when voltage difference information, output from the voltage measurement unit at a predetermined time point after a control period of voltage supply by the first voltage supply unit and the second voltage supply unit for valve opening control of the fuel injection valve, does not become equal to or less than a threshold that the voltage difference information is assumed to be equal to or less than when the voltage measurement unit is normal at the predetermined time point.

12. The fuel injection control device according to claim 1, wherein the correction unit stops correcting the fuel injection amount based on the voltage information output by the voltage measurement unit when the abnormality detection unit determines that the output of the voltage measurement unit is abnormal.

13. The fuel injection control device according to claim 1, wherein the abnormality detection unit stores information indicating the abnormality in a storage device when determining that the output of the voltage measurement unit is abnormal.

14. A fuel injection control method performed by a fuel injection control device including: a first voltage supply unit that supplies a first voltage; a second voltage supply unit that supplies a second voltage higher than the first voltage; and a fuel injection control unit that controls the second voltage supply unit to supply the second voltage to a coil so as to open a fuel injection valve having the coil, and controls the first voltage supply unit to supply the first voltage to the coil so as to hold a valve-open state of the fuel injection valve, the fuel injection control method comprising:

measuring and outputting voltage information based on an upstream voltage of the coil of the fuel injection valve and a downstream voltage of the coil;

correcting a fuel injection amount of the fuel injection valve based on the voltage information; and detecting whether the voltage information is abnormal based on the voltage information.

* * * * *